United States Patent [19]

Fisher et al.

[11] Patent Number: 4,545,118

[45] Date of Patent: Oct. 8, 1985

[54] APPARATUS FOR PRODUCING SLIDE FASTENERS FROM CONTINUOUS FASTENER CHAIN

[75] Inventors: Harry Fisher, Whitestone; Stuart Fisher, Floral Park, both of N.Y.

[73] Assignee: Yoshida Kogyo K. K., Tokyo, Japan

[21] Appl. No.: 670,809

[22] Filed: Nov. 13, 1984

Related U.S. Application Data

[62] Division of Ser. No. 458,457, Jan. 17, 1983, Pat. No. 4,495,686.

[51] Int. Cl.[4] ..... B21D 51/50

[52] U.S. Cl. ..... 29/768; 29/408

[58] Field of Search ..... 29/33.2, 408–410, 29/766–769

[56] References Cited

U.S. PATENT DOCUMENTS 4,236,304 12/1980 Morita ..... 29/768
4,355,461 10/1982 Doori ..... 29/768
4,392,291 7/1983 Iai ..... 29/766
4,433,478 2/1984 Oyama ..... 29/408

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method and apparatus for attaching sliders and bottom stops to a slide fastener chain having longitudinally spaced gaps free of fastener elements, in which the chain is conveyed forwardly until a gap is detected. The chain is stopped and the gap area widened. A rotor movable beneath the chain is adapted to carry a slider and is also formed with a die plate portion. The rotor rotates to deliver the slider to the gap, thread the slider onto the fastener elements of the chain, and place the die plate beneath the gap across from bottom stop punch and chain cutter means which then fix a bottom stop to the chain and separate adjacent fastener element ends.

9 Claims, 24 Drawing Figures

APPARATUS FOR PRODUCING SLIDE FASTENERS FROM CONTINUOUS FASTENER CHAIN

This is a division of application Ser. No. 458,457, filed 1/17/83, now U.S. Pat. No. 4,495,686.

BACKGROUND OF THE INVENTION

The invention relates to a method and apparatus for assembling individual slide fasteners from a continuous fastener chain having longitudinally spaced gaps and, more particularly, to a method and apparatus for mounting sliders on and fixing bottom stops to a continuous fastener chain and cutting the continuous fastener chain into individual slide fasteners.

It has been known in this industry to automate the assembly of slide fasteners to achieve increased efficiency and reduced manual labor. One such apparatus is disclosed in U.S. Pat. No. 3,629,926 wherein individual fasteners are produced from a continuous fastener chain. The apparatus of this patent requires a high number of individual mechanical steps, such that it is difficult to produce fasteners at very high speed. In this known apparatus, the sliders and bottom stops are carried by a swing arm into position along the feed path of the continuous fastener chain. First grippers grip the chain adjacent a leading end thereof and move the chain forward so that the leading end of the chain is threaded through the slider and top stop. With the slider positioned on the fastener chain, the top stop is deformed to clamp securely to the chain adjacent the leading end thereof and the swing arm returns to its original position. Second grippers then engage the leading end of the chain to advance the chain by a pre-determined amount such that the tail end gap comes in registration with a cutter. The first grippers return to their original position to hold the chain near the gap and the assembled slide fastener is cut at the gap from the continuous fastener chain. The second grippers then withdraw the individual slide fastener from the apparatus.

Another representative example of the prior art in this field is disclosed in U.S. Pat. No. 3,663,000 in which sliders are attached to a continuous fastener chain in the following manner. The continuous fastener chain is gapped at longitudinal intervals and fed to a slider assembler where the chain is stopped with the gap located at the assembly station. The gap is spread transversely enough to receive a slider. A slider attaching means receives a slider and approaches the chain gap from a lower position to set the slider in the gap. As the final step, the scoops of the chain stringer are threaded in the slider which has been stationarily set in the gap. According to this apparatus, the chain has to be temporarily held stationary while the slider is inserted in the gap, which takes a rather long time and makes it difficult to produce fasteners at relatively high speed.

Objects of the present invention include to provide a novel method and apparatus by which sliders can be mounted more efficiently at a high rate on a continuous fastener chain having longitudinally spaced gaps and to provide a novel method and apparatus for mounting sliders on and fixing bottom stops at a high rate to a continous slide fastener chain having longitudinally spaced gaps. Other objects, advantages, and novel features of the present invention will become apparent from the following description of the preferred embodiment and claims.

SUMMARY OF THE INVENTION

Slide fasteners are produced from a continuous fastener chain in a high speed fashion by means of automatic, sequentially operated mechanisms. A continuous fastener chain having longitudinally spaced gaps is axially directed to an assembly station where a gap sensor and enlarger means detects a gap in the continuous fastener chain and thereupon halts the feed of the fastener chain in the assembly station. A rotor having a slider holding portion and a die plate circumferentially spaced from each other by a pre-determined angle is mounted in the assembly station beneath the fastener chain for back and forth swivel movement about a lateral axis. With the fastener chain halted such that the gap is located in the assembly station, the rotor rotates in a first direction for moving a slider received in the slider holding portion along the fastener chain to the gap, now enlarged, so that the fastener chain is threaded through the slider by rotation of the rotor.

Disposed above the gap in the assembly station and facing the rotor is a vertically reciprocable bottom stop fixing means and cutter. When the rotor rotates to make the fastener chain threaded through the slider, the die plate portion of the rotor is passed to an upwardly directed position facing the bottom stop fixing means and the cutter from beneath the gap. The bottom stop fixing means and the cutter descend to fix a bottom stop to the fastener chain as well as to cut the fastener chain at the gap. The rotor then rotates in a second opposite direction back to its original position, such that the individual assembled slide fastener is discharged from the assembly station.

As a result of the inventive method and apparatus, three operation steps, namely assembling the slider onto the fastener chain, fixing the bottom stop, and cutting the fastener chain, are effectively achieved in a single assembly station without requiring further feeding of the chain as a result of the uniquely configured rotor and pre-determined rotation thereof. Due to the time savings involved, it is possible to produce individual fasteners at a high rate from a continuous fastener chain.

DESCRIPTION OF THE PREFERRED EMBODIMENT

Figure 1:
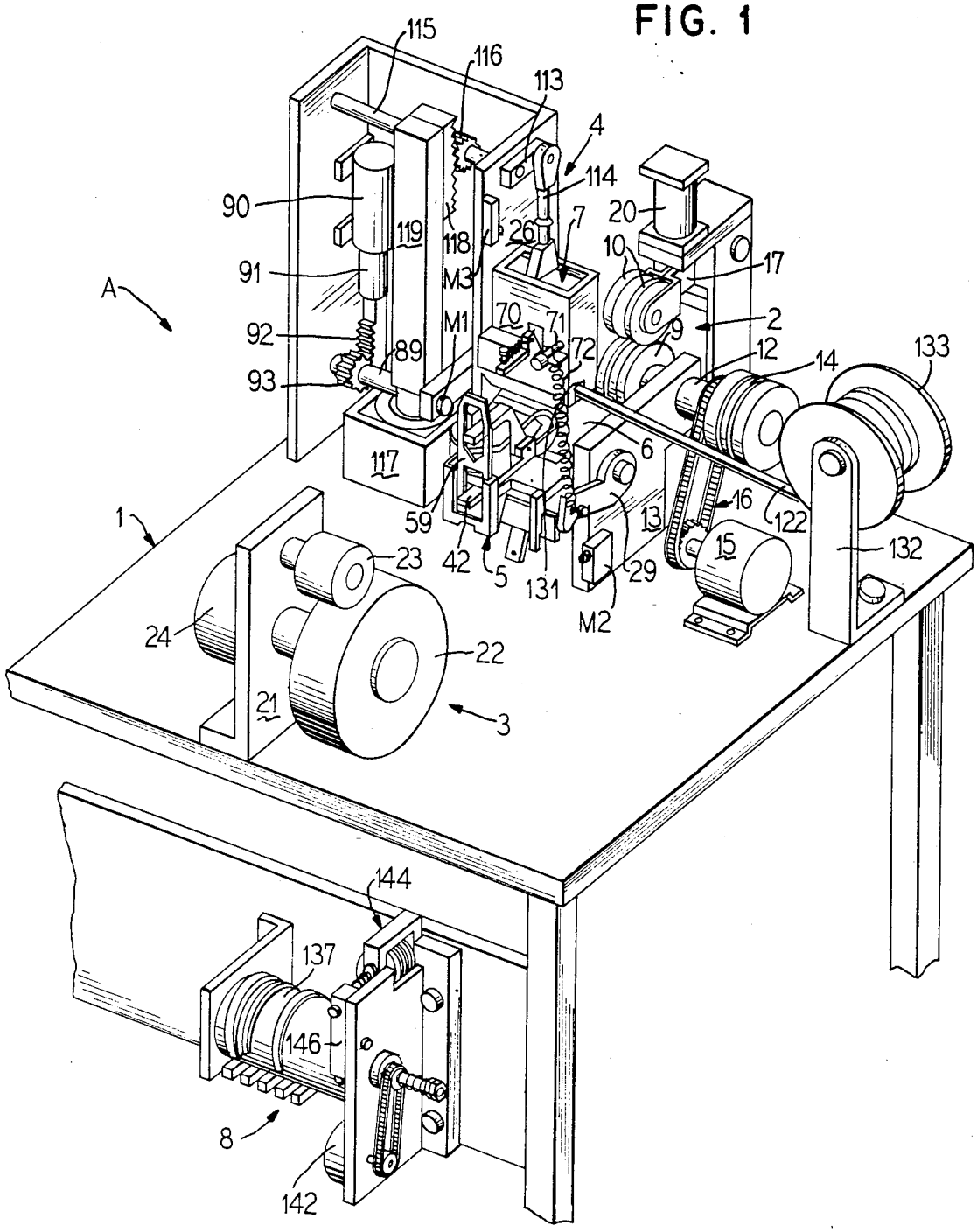
FIG. 1 is a perspective view of an automated slide fastener assembler constructed in accordance with the present invention.

FIG. 1 illustrates an automated mechanism A constructed and operated in accordance with the present invention apparatus and method for assembling individual slide fasteners from a continuous fastener chain. The continuous fastener chain is of a conventional type comprising a pair of continuous length stringer tapes having alternating element-containing and elementfree or gap sections at longitudinally spaced intervals. The continuous fastener chain may consist of a fastener stringer or tape alone or may consist of a stringer having garment portions, such as a trouser fly, secured thereto.

The assembler mechanism A, as shown in FIG. 1, comprises a table or platform support 1 on which is mounted chain transport or feeding devices in the form of a main driver roller means 2 and an auxiliary driver roller means 3 disposed at opposed lateral sides of the table 1. Positioned between the main and auxiliary drive roller means is a stringer assembly station 4 including a gap sensor and enlarger means 5, a slider mounting means 6, and a combined vertically reciprocable bottom stop fixing and cutting device 7. Preferably disposed adjacent or on the platform 1 is also a sequence control device 8 for sequentially operating various mechanisms of the assembler A in timed sequence to produce an individual assembled slide fastener from the continuous fastener chain.

The main drive roller means 2 has a drive roll 9 disposed for rotation about a lateral axis beneath a pair of spring-biased downward pinch rolls 10 disposed for rotation about a parallel lateral axis. The drive roll 9 is secured to a driveshaft 12 supported by a frame 13 and engaged at the end opposite the drive roll with an electro-magnetic clutch 14. The shaft 12 is powered from a rotary electric motor 15 drivingly connected through suitable sprocket and chain means 16 to the electromagnetic clutch 14 for transmitting rotary power to the shaft 12.

Figure 2:
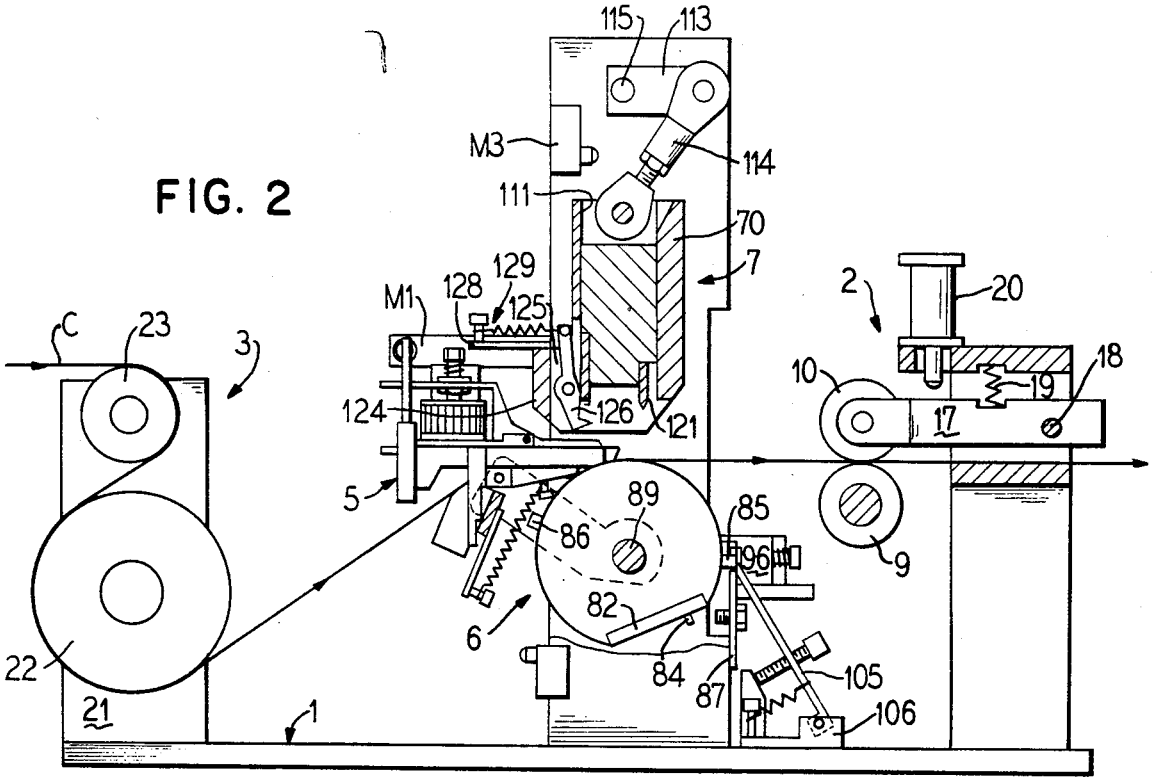
FIG. 2 is a partial side-elevational view of the assembly station on the assembler of FIG. 1, wherein the gap sensor and enlarger means is in a detecting position.
Figure 3:
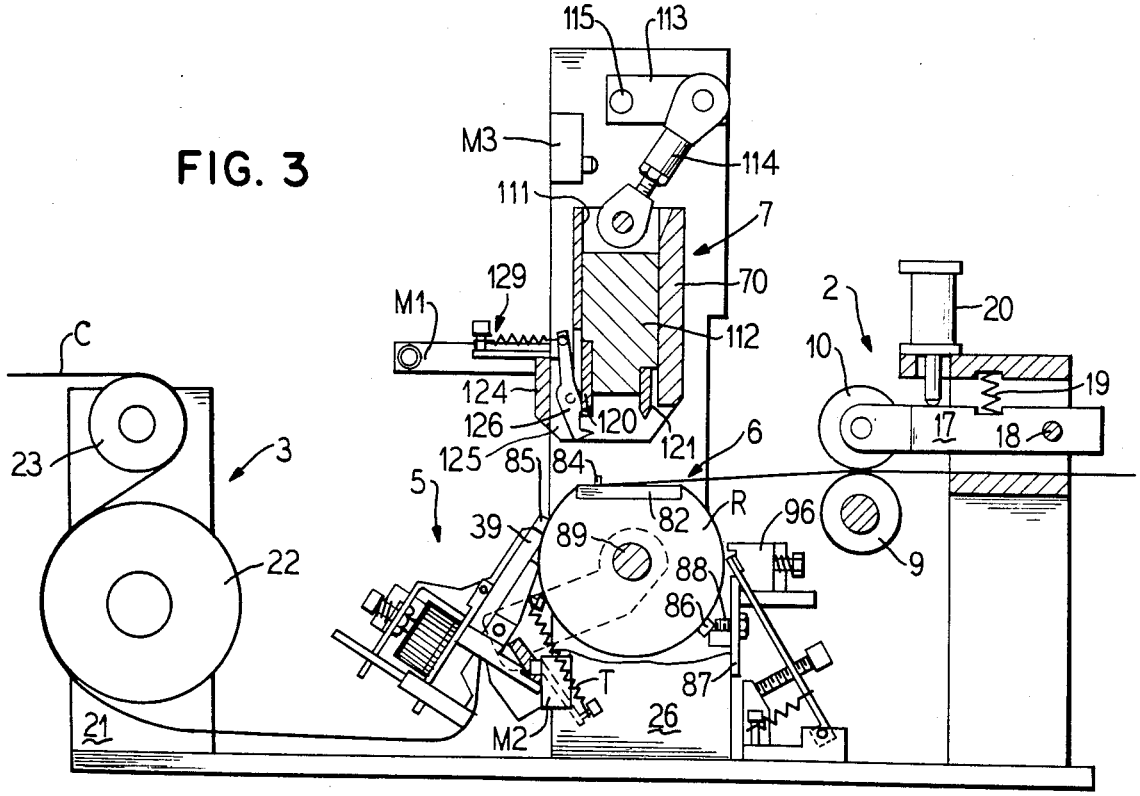
FIG. 3 is a partial side-elevational view of the assembly station of the assembler of FIG. 1, wherein the rotor is positioned for fixing the bottom stop and cutting the assembled slide fastener at one end.

With further reference to FIGS. 2 and 3, the pair of pinched rolls 10 are journaled for rotation at the free end of an arm 17 pivotable about a laterally directed post 18. The arm 17 is biased downwardly by a spring bias 19 so that the pinch rolls 10 bear against the drive roll 9. An air piston-cylinder device 20 is provided above the arm 17 to intermittingly advance its piston against the upper surface of the arm 17 to provide further positive pressure against the arm at pre-determined intervals.

The auxiliary drive roller means 3 is supported by a bracket wall 21 and comprises a drive roll 22 of a relatively large diameter spaced beneath a relatively smaller diameter free-wheeling roll 23. The rolls 22 and 23 are disposed at the end of laterally extending shafts journaled in the bracket 21 for rotation about parallel lateral axes. The drive roll 22 is driven for rotation by an electric motor 24 disposed at one end of the drive roll shaft. The motor 24 is adapted with suitable means, such as a slip clutch, to rotate the drive roll 22, and hence advance the fastener chain, when the fastener chain wound on the drive roll has a predetermined tension.

The gap sensor and enlarger means 5 is supported on the frame wall 13 and a further vertically upstanding frame wall 26 as shown in FIG. 1. With reference to FIGS. 1 and 4–6, the gap sensor and enlarger means 6 is supported for rotation about the frames 13 and 26 by a swing arm assembly 27 formed in a Ushaped configuration by a pair of pivot arms 29 and a lateral cross member 30 bridging the outer free ends of the arms 29. The cross member 30 has a fastener element guide 31 and an outwardly extending plate 33 provided with an inwardly projecting bolt 32.

Figure 5:
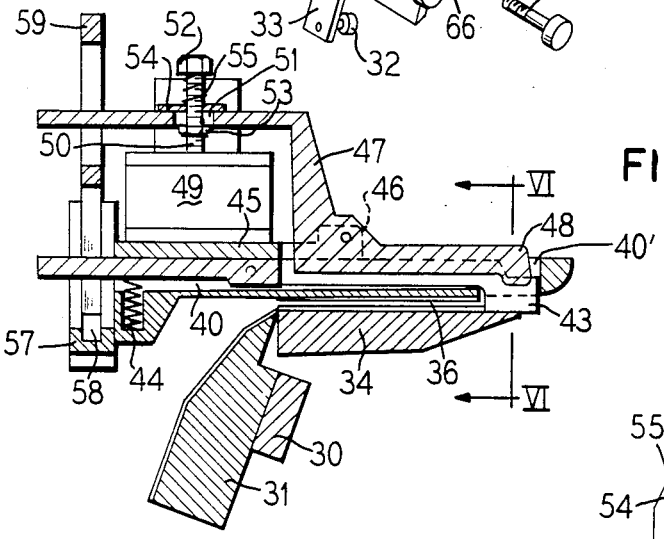
FIG. 5 is a cross-sectional view of the gap sensor and enlarger means.
Figure 6:
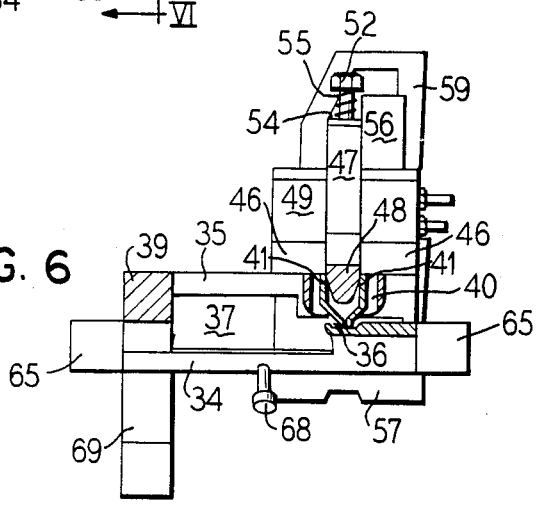
FIG. 6 is a cross-sectional view taken along the lines of VI—VI of FIG. 5.

A main portion 28 of the gap sensor and enlarger means comprises a lower plate 34 and an upper plate 34 overlapping with each other to form therebetween a fastener element guide path 36, shown in FIGS. 5 and 6, and an adjacent guide space 37 for accommodating possibly attached garment portions along the fastener element guide path. The upper plate 35 has a forward extension 39 at one side thereof formed with a recess 38. The upper plate also has a groove 40, shown in FIGS. 5 and 6, in the other side thereof above the element guide path 36.

Pivotally mounted on the groove 40 is a gap detector 42, the forward end of which is bifurcated to form two fingers 41. The forward ends of the fingers 41 are formed with downwardly projecting claws 43. The gap detector 42 is biased in a clockwise direction by a spring 44 which engages the rearward end of the gap detector so that the claws 43 extend downwardly through an opening 40 prime formed at the forward end of the groove 40 and bear against the bottom of the fastener element guide path 36 formed in the lower plate 34.

A bearing plate 45 is provided on the upper plate 35 to cover the groove 40. The forward end portion of the plate 45 is bifurcated to form bearings 46 by which a crank lever 47 is pivotally supported. The forward half of the lever 47 is positioned between the pair of fingers 41 of the gap detector 42 and the forward end of this forward half is formed into a cam surface 48. The rearward half of the lever 47 extends upward to form a space with the bearing plate 45 in which an air piston-cylinder 49 is positioned. A piston rod 50 extends from the air cylinder 49 through an elongated opening 51 in the rearward half of the crank lever 47. The piston rod 50 has two nuts 52 and 53 adjustably disposed along the length thereof above and below the lever 47. A spring 55 extends between the upper nut 52 and a washer 54 for pressing the rearward half of the lever 47 against the lower nut 53. When the piston rod 50 is passed upward, the crank lever 47 rotates in a clockwise direction as viewed in FIG. 5 with the side surfaces of the lever guided along a guide lock 56 mounted on the upper surface of the cylinder 49. This movement results in the cam 48 at the forward end of the crank lever 47 becoming wedged between the pair of claws 43 of the gap detector 42 to laterally separate them.

A U-shaped holder 57 is fixed to the rear end of the upper plate 35 and a groove 58 is formed in the upper surface of the holder. A swing plate 59 of a generally A-shaped configuration is received at its lower end in the groove 58 and is pivotally connected to one lower corner portion of the holder 57.

Figure 7:
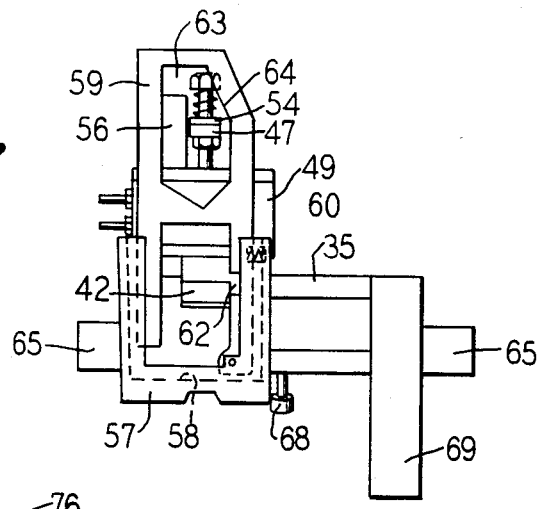
FIG. 7 is a rear elevational view of the gap sensor and enlarger means, wherein the swing plate is in its vertical position.

With particular reference to FIG. 7, the swing plate 59 is movable between an upright position and an inclined position and is biased in the counterclockwise direction by a spring 60 provided between the holder 57 and a side surface of the swing plate 59. The lower half of the swing plate 59 has an opening 61, one side of which adjacent the spring 60 has a notch recess 62. The rear end portion of the gap detector 42 extends through the opening 61 and engages in the notch 62 when the swing plate is in the inclined position and is locked there. The upper half of the swing plate 59 has an opening 63, a portion of which is defined by an inclined cam surface 64 portion of the swing plate 59. The rear half of the crank lever 47 extends through the opening 63 and engages with the cam surface 64 when the lever rotates in the clockwise direction as shown in FIG. 5 so as to rotate the swing plate 59 in the clockwise direction as shown in FIG. 7 against the effect of the spring 60, thereby releasing the engagement between the gap detector 42 and the notch 62.

Figure 4:
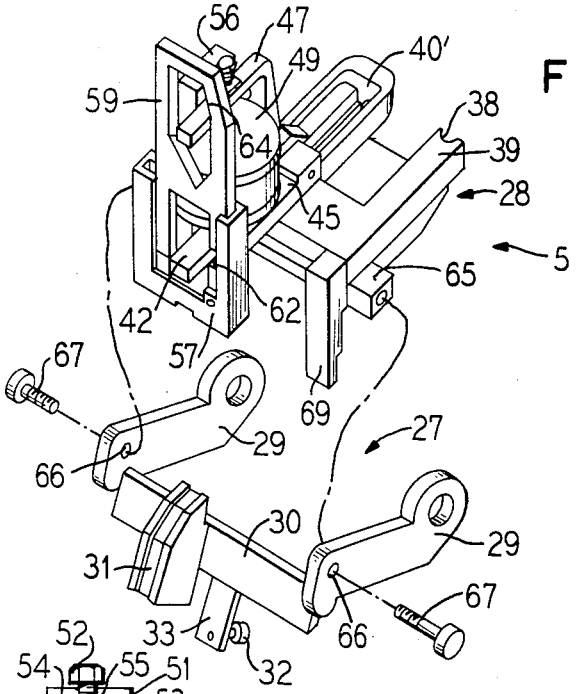
FIG. 4 is an assembly perspective view of the gap sensor and enlarger means.

Mounting lugs 65 are formed on opposite sides of the rear end portion of the lower plate 34. As illustrated in FIG. 4, a pair of bolts 67 loosely fit in holes 66 in the swing arm assembly 27 and these bolts are screwed into the mounting lugs 65.

Extending from the lower side of the lower plate 34 is a bolt 68. A tension spring T, shown in FIGS. 2 and 3, is connected between the bolt 68 and the bolt 32 of the swing arm assembly 27 to bias the main portion 28 such that the forward end of the main portion 28 bears against the outer peripheral surface of a rotor R (described further below).

A downwardly extending stop wall 69 is connected to the upper plate 35 of the main portion 28 at the rear end of one side of the upper plate. The distance by which the forward end of the main portion 28 can move apart from the outer peripheral surface of the rotor is limited by engagement between the stop wall 69 and the cross member 30 of the swing arm assembly 27.

The main portion 28 is kept in substantially horizontal position by a tension spring 72 stretched between one of the bolts 67 and a bolt 71 fastened into a framework 70, as shown in FIG. 1. It will be noted that FIG. 7 illustrates the swing plate 59 in its upright position, whereas FIGS. 5–6 illustrate the gap sensor and enlarger means 6 when the swing plate 59 is in an inclined position and a gap in the chain is detected.

Figure 8:
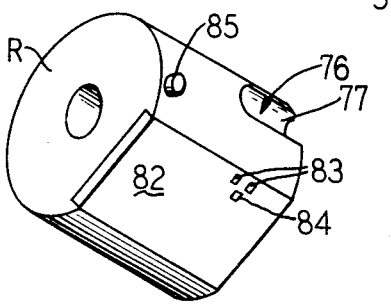
FIG. 8 is a perspective view of the rotor.
Figure 9:
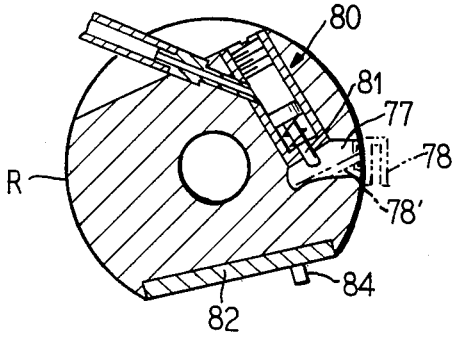
FIG. 9 is a cross-sectional view of the rotor of FIG. 8.
Figure 10:
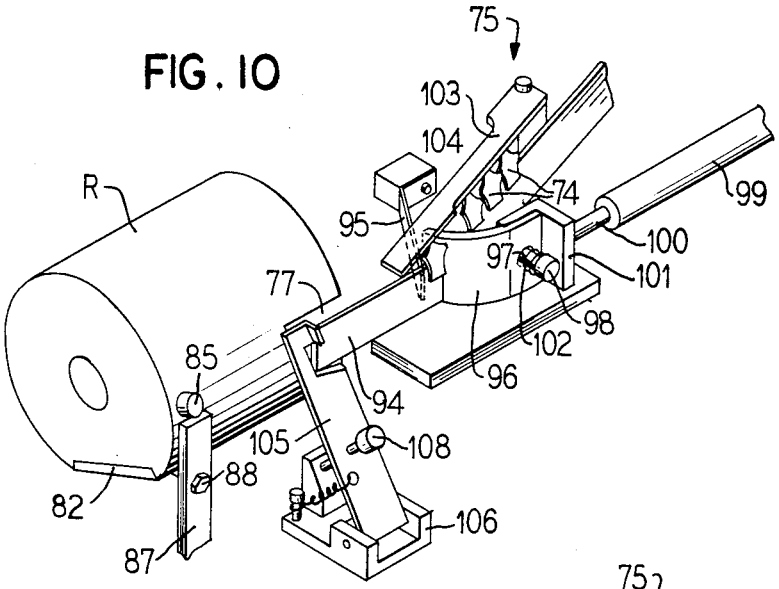
FIGS. 10–12 are perspective views illustrating the operation of a slider feeding device passing individual sliders to the slider holding portion of the rotor of FIG. 8.
Figure 11:
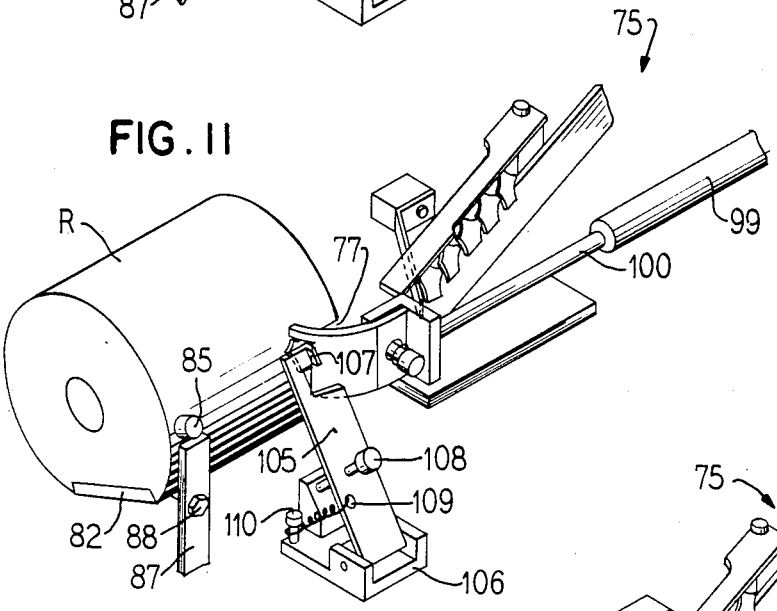
Figure 12:
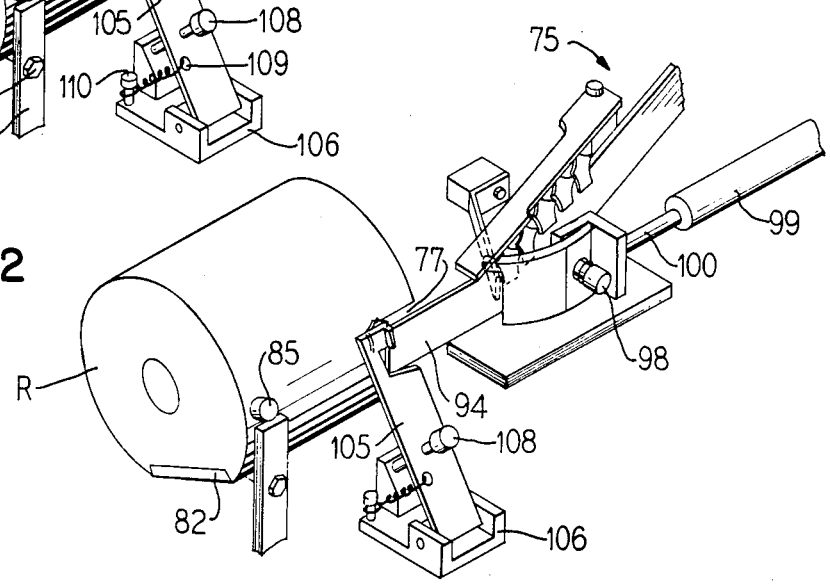

The slider mounting means 6 will now be described with reference to FIGS. 8–12. With particular reference to FIGS. 8 and 9, the slider mounting means 6 comprises the rotor R disposed for back and forth swivel rotation on a lateral axis by the frames 13 and 26. With particular reference to FIGS. 10–12, the slider mounting means 6 further comprises a slider feeding assembly 75 for dispensing sliders 74 in seritim.

As shown in FIGS. 8–9, the rotor R is of a generally cylindrical configuration and has a slider holding portion 76 at one side thereof. The holding portion comprises a recess 77 which opens to both the outer peripheral surface and one side end surface of the rotor. When a slider 74 is supplied to the holding portion 76, the body 78 of the slider is engaged in the recess and moves along the opening at the outer periphery of the rotor, while the pull member 78' of the slider enters into the recess 77 from the opening in the side end surface and moves along in the recess. During this movement, the pull is conducted along an inner wall of the recess. A clamp piston device 80 is embedded within the rotor R facing toward the bottom interior portion of the recess. The device 80 includes a movable piston rod 81 which is selectively extendible into the recess for clamping the free end of the pull 78' against an inner wall of the recess to keep the pull fixed in place.

A planar die plate 82 is mounted on the rotor at a place angularly spaced from the slider holding portion 76. The die plate has, adjacent one edge thereof, a pair of bottom curling dies 83 and a registration pin 84.

The rotor R has a pair of stop pins 85 and 86, as shown in FIGS. 2 and 3, circumferentially spaced from one another by a predetermined angle. The stop pin 85 limits rotation of the rotor R in the clockwise direction as shown in FIG. 2 by engagement with the upper edge of a stop plate 87 secured to the frame 13. The other stop pin 86 limits counterclockwise rotation of the rotor R by engagement with the end portion of a bolt 88 screwed into the stop plate 87 as shown in FIG. 3.

With further reference to FIGS. 2 and 3, the rotor R is rotatably supported by the frames 13 and 26 through a drive shaft 89 so that it rotates about the same lateral axis of rotation as the swing arm assembly 27. Upon retraction of a piston rod 91 into an air cylinder 90 (as shown in FIG. 1), the rotor R rotates in the counterclockwise direction as shown in FIG. 2 by cooperation between a rack 92 and a pinion 93. Upon extension of the piston rod 91, the rotor rotates in the clockwise direction. When the rotor rotates in the counterclockwise direction, the stop pin 85 engages in the recess 38 of the extension 39 of the gap sensor and enlarger means 5 to rotate the means 5 in the counterclockwise direction against the effect of the spring 72 to the position shown in FIG. 3.

As shown in FIG. 10, the slider feeding assembly 75 comprises a guide member 94 extending with its free end adjacent the slider holding portion 76 of the rotor R. The individual sliders 74 are fed along the upper edge of the guide member 94 from a suitable supply, such as a vibratory hopper, by gravity. One end of a resilent stop plate 95 bears against one side of the guide member 94 to arrest a downwardly moving slider on the guide member. A slider advancing claw 96 is provided on the other side of the guide member 94 for sliding movement along the guide member. The slider advancing claw has an elongated hole 97 in its tail end portion and the claw is pivotally connected to an L-shaped holder 101 fixed to the end of a piston rod 100 of an air cylinder 99 by means of a bolt 98 passing through the elongated hole 97. The claw is biased to the guide member 94 by a spring 102 wound around the bolt 98 so that the free end portion of the claw 96 wedges between adjacent sliders on the guide member 94.

A resilient cam plate 103 is placed above the guide member 94 having a cam surface 104 along the side portion facing the slider advancing claw 96.

When the piston rod 100 of the air cylinder extends toward the rotor R, the claw 96 moves against the forces from the resilient stop plate 95 and the cam plate 103 to feed the lead slider to the slider holding portion 76 of the rotor. Upon retraction of the piston rod 100, the slider advancing claw 96 returns to its original position. When the claw returns, it engages the cam surface 104 of the cam plate 103 to swing the claw away from the guide member 94 against the effect of the spring 102 so that the end portion of the claw 96 is free from the leading one of the subsequent remaining sliders. In this manner, it is assured that the end portion of the claw back in its original position wedges between the lead and next adjacent sliders stacked along the guide member 94.

With reference to FIG. 11, a pressure plate 105 is mounted on the table 1 to face the slider holding portion 76 of the rotor R. The lower end of the pressure plate 105 is pivotally connected to a bracket 106 and the other free end has a cam surface 107 facing the guide member 94. A bolt 108 is screwed through the pressure plate centrally thereof so that the lower end of the bolt contacts a stop surface rising from the bracket 106. The position of the bolt 107 is adjustable so that the space between the upper end of the pressure plate 105 and the slider holding portion 76 can be varied. A tension spring is connected between a hole 109 formed near the bolt 107 and a bolt 110 fastened in the bracket 106 to bias the pressure plate 105 toward the slider holding portion 76. When a slider is supplied to the slider holding portion 76 by the claw 96, the slider engages the cam surface 107 of the pressure plate 105 to swing the plate 105 in clockwise direction against the effect of the tension spring and thus take a position between the slider holding portion 76 and the plate 105. Thus, as shown in FIG. 12, the slider is supplied to the slider holding portion 76 and is reliably retained there by the pressure plate 105 until the clamp piston device 80 within the rotor R fixes the slider in place with the recess 77.

FIG. 12 illustrates the movement of the claw 96 along the guide member 94 as it retracts back to its original position for engagement behind a further lead slider 74 in the stack.

As shown in FIGS. 1 to 3, the framework 70 is of rectangular cross-section and provided above the rotor to house the bottom stop fixing and cutting device 7. The frame 70 defines a guide passage 111 therein, in which a ram 112 is received for vertical sliding movement. The upper end of the ram 112 is connected to a rotary shaft 115 through crank links 113 and 114. A pinion 116 is formed on the shaft engaged by a rack 118 secured on a reciprocating piston 119 movable by an air cylinder 117. The ram 112 moves up and down in the guide passage 111 in response to extension and retraction of a piston rod 119 of the cylinder. The ram 112 has a bottom stop punch 120 at one side and a chain cutter 121 at the other side.

Figure 13:
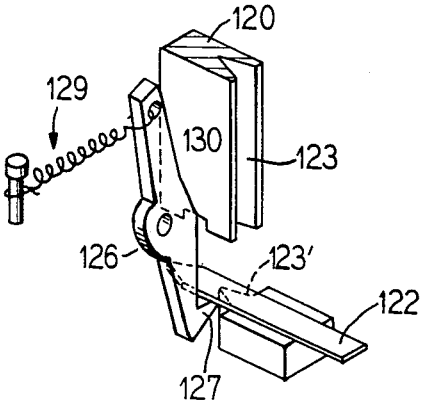
FIGS. 13–14 are perspective views illustrating the opertion of a bottom stop fixing means of the assembler of FIG. 1.
Figure 14:
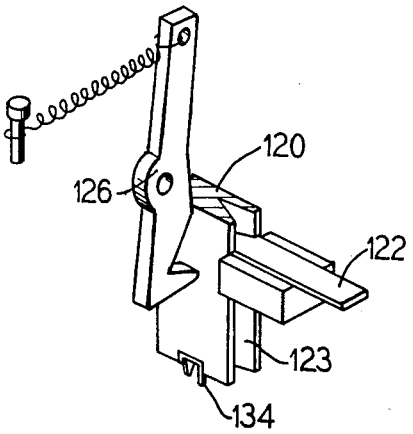

FIGS. 13–14 illustrate operation of the bottom stop punch 120. The raised, starting position of the punch 120 is shown in FIG. 13. One edge of the punch forms a cutter blade 123 and a V-shaped die 123′ is provided in the passage 111 so that the V-shaped die faces the cutter blade. A block 124 is mounted on the back side of the frame 70 as shown in FIGS. 1–3. This block has a vertical channel 125 facing the punch 120 and a lever 126 is pivotally mounted in the channel. The lever 126 has a bender projection 127 extending from the lower end thereof toward the punch. The lever is biased in the counterclockwise direction as shown in FIGS. 2–3 by a spring-bias connection 129 disposed on a plate 128 horizontally extending from the block 124. As a result of this arrangement, the bender projection 127 of the lever 126 is normally right below a recess 130 formed in the bottom end of the punch.

One side wall of the frame 70 has a horizontal hole 131 (shown in FIG. 1) which opens to the space above the die 123′. A flat wire 122 fed from a wire roll 133 rotatably supported on a stand 132 rising from the table 1 is lead onto the upper surface of the die 123′ through the horizontal hole 131. The wire 122 is supplied by an intermittent advancing mechanism (not shown), such as of conventional type, to the die 123′. Thereafter, the ram 112 descends and a lead end of the wire 122 is cut between the cutter blade 123 of the descending punch 120 and the die 123′ and thereafter the cut length of the wire is bent into a U-shape by the projection 127 of the lever 126 and the recess 130 at the lower end of the punch 120 to form a bottom stop 134. The stop is retained in the recess 130. The lever 126 is rotated in a clockwise direction against the spring bias 129 by the descending punch 120 so that it automatically disengages the bottom stop 134 as shown by FIG. 14. Thus, the bottom stop 134 descends with the punch retained in the recess 130 of the punch 120 and is urged against the curling dies 83 on the die plate 82 of the rotor R.

Figure 15:
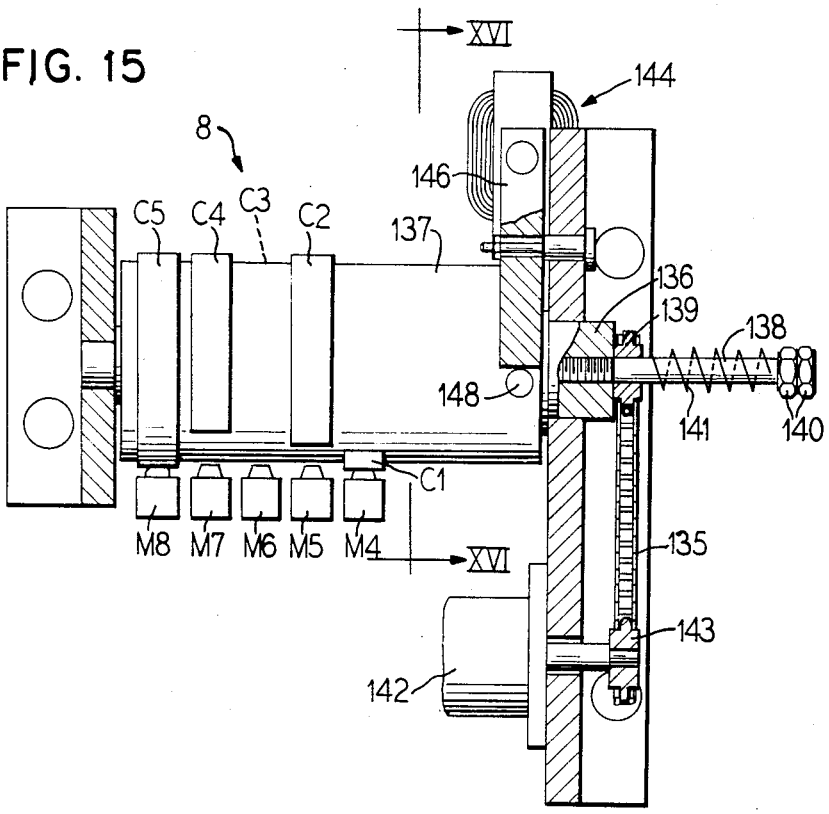
FIG. 15 is a partly cross-sectional view front elevation of a sequence control mechanism used in the assembler of FIG. 1.

The sequence control device 8, mounted as shown in FIG. 1 on the side of the table 1, will now be described. The device 8 comprises a rotary cam shaft 137 rotatably supported between suitable brackets. As shown in FIG. 15, a bolt 138 is screwed in at one hub end portion 136 of the cam shaft 137. A sprocket 139 is fit on the bolt 138 for relative rotation thereto. Adjuster nuts 140 are screwed on the free end of the bolt 138. A compression spring 141 is wound about the bolt between the sprocket 139 and the nuts 140 so that the sprocket 139 bears against the side surface of the hub portion 136 of the cam shaft. A chain 135 is passed around the sprocket 139 and another sprocket 143 secured to the main shaft of a motor 142 so that rotation of the motor 142 is transmitted to the cam shaft 137 by the friction between the sprocket 139 and the side surface of the hub portion 136.

There are five microswitches M4–M8 positioned side-byside below the cam shaft 137. These microswitches are engagable with five cams C1–C5 formed on the cam shaft 137, respectively.

Figure 16:
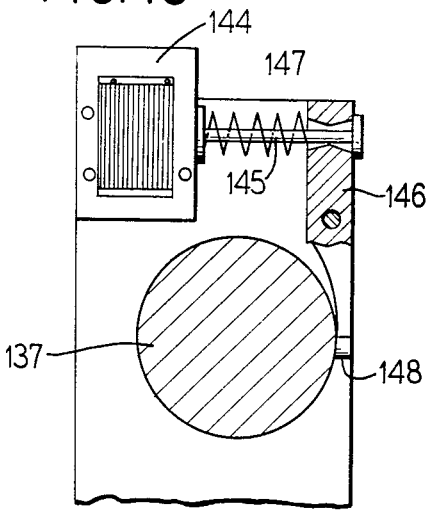
FIG. 16 is a cross-sectional view taken along the lines XVI—XVI in FIG. 15.

A solenoid-piston 144 is mounted on the upper portion of one support bracket and the free end of the plunger 145 of this solenoid-piston is loosely connected to the upper end of a lever 146 pivotally mounted on the bracket. The lever 146 is biased in clockwise direction as seen in FIG. 16 by a compression spring 147 wound about the plunger 146 so that the lower end of the lever bears against the outer periphery of the cam shaft 137. When a pin 148 projecting from the outer surface of the cam shaft 137 engages the lower end of the lever 146, a great drag is given to the cam shaft 137. Therefore, the sprocket 139 slips and the rotation of the motor 142 is not transmitted to the cam shaft 137. Thus, the cam shaft is kept stopped until the lever 146 is disengaged from the pin 148.

The sequence control device 8 also includes microswitches M1, M2, and M3 as shown in FIG. 1. The microswitch M1 is mounted on the frame 26 so that it is actuated by the associated upper corner portion of the swing plate 59 when the swing plate is moved to its inclined position. The microswitch M2 is mounted on the frame 13 so that it is actuated by the downward movement of the swing arm assembly 27. The microswitch M3 is also mounted on the frame 26 so that it is actuated by the link 113 when the punch 120 and the cutter 121 descend.

Figure 17:
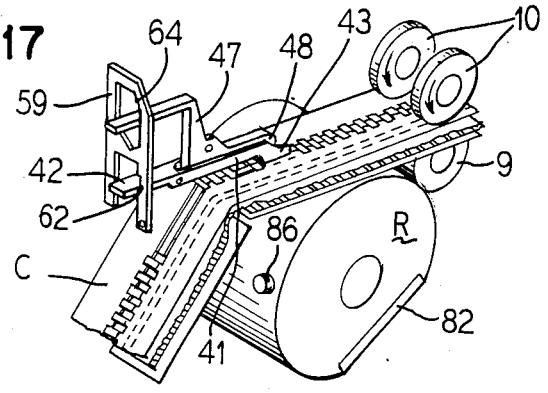
FIGS. 17–23 are perspective views illustrating the operation of the rotor of FIG. 8 for producing individual fasteners from a continuous fastener chain in the assembler of FIG. 1.

The assembler apparatus A is adapted for continuous operation on an endless fastener chain C being conducted along a horizontal travel path. One cycle of operation of the assembler occurs in the following manner and sequence with particular reference to FIGS. 17–24. (1) First, the fastener chain is threaded through the auxiliary drive roller means 3 and the gap sensor and enlarger means 5 and along the upper side of the rotor R and then through the main drive roller means 2. When the fastener chain C is to be threaded through the gap sensor and enlarger means 5, the swing plate 69 is moved to its vertical, upright position and the detector 42 is rotated in the counterclockwise direction as shown in FIG. 5 so that the claws 43 at the end of the detector retract from the guide path 36. Thereafter, the chain of the interengaged fastener scoop elements is threaded through the guide path 36. Thus, when the fastener chain C is threaded, the claws 43 of the gap detector 42 bear against the elements and the swing plate 59 is locked in its upright position by the side surface of the rear end portion of the detector 42 as shown in FIG. 17.

(2) When a main switch (not shown) is turned on, the motors 15, 24, and 142 for the main drive roller means 2, the auxiliary drive roller means 3, and the sequence control device 8, respectively, start operation. The cam shaft 137 rotates as the motor 142 rotates until its pin 148 engages the lever 146 where it is set in its starting position.

Figure 24:
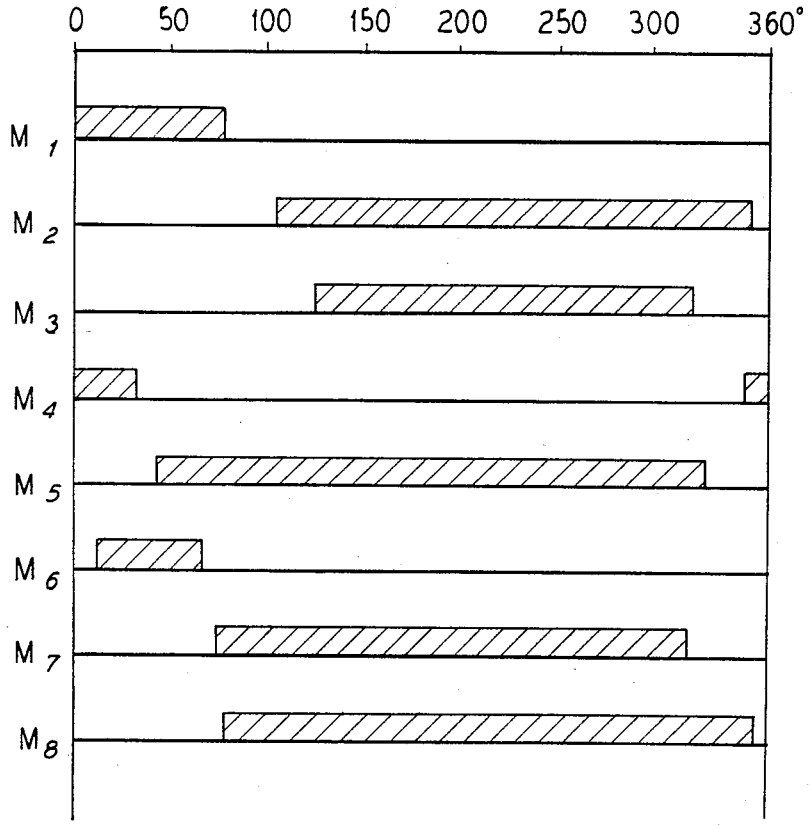
FIG. 24 is a bar graph indicating the sequence of operation of the microswitches in terms of angular position of a cam shaft of the sequence control device of FIG. 15.

(3) When a starter switch (not shown) is turned on, the electromagnetic clutch 14 of the main drive roller means 2 is energized, since the microswitch M4 has been actuated as indicated in FIG. 24, to rotate the drive roller 9 thereby advancing the fastener chain C.

Figure 18:
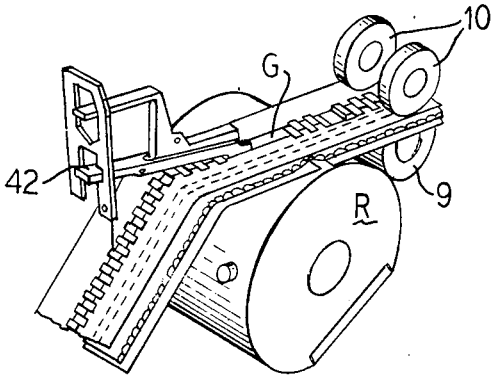

(4) When a fastener element-free gap portion G of the chain C passes beneath the claws 43 of the detector 42, the claws move down in the gap G by the effect of the spring 44 while the detector 42 rotates in the clockwise direction as seen in FIG. 18. Thus, the rear end portion of the detector 42 moves up to the notch 62 of the swing plate 59 to cause the swing plate 59 to move to its inclined position. When the swing plate moves to he inclined position, the upper corner portion thereof actuates the microswitch M1.

(5) Actuation of the microswitch M1 deenergizes the electro-magnetic clutch 14 of the main drive roller means 2 thereby stopping advancement of the fastener chain C. Simultaneously, the solenoid 144 of the sequence control device 8 is energized to disengage the lever 146 from the pin 148 thereby causing the cam shaft 137 to start rotation.

(6) As the cam shaft 137 rotates, the microswitch M6 is first hit to cause the air cylinder 99 of the slider feeding assembly 75 to extend its position rod. By this operation, the slider 74 is supplied to the slider holding portion 76 of the rotor R and wire feeding means (not shown) simultaneously operates to feed the wire 122 to the bottom stop fixing means by a predetermined amount.

(7) The microswitch M4 returns to its original condition to prepare for the next cycle.

(8) The microswitch M5 is then hit to actuate the clamp piston device 80 so that the its piston presses the pull 78' of the slider against the wall of the slider holding portion 76.

(9) The microswitch M6 returns to its original condition to make the air cylinder 99 of the slider feeding assembly 75 and the wire feeding means (not shown) resume their original positions.

Figure 19:
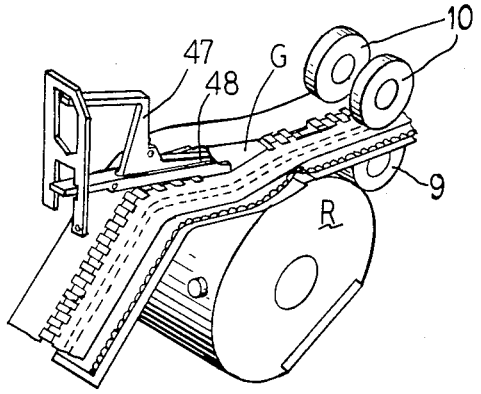

(10) The microswitch M7 is hit by the cam ring C4 on the cam shaft 137 to actuate the cylinder 49 of the cap sensor and enlarger means 5. By this operation, the crank lever 47 rotates in clockwise direction as seen in FIG. 19 causing the V-shaped cam 48 at the end thereof to wedge between the pair of the detector fingers 41 to laterally separate them thereby enlarging the gap portion G. Simultaneously, the air cylinder 20 of the main drive roller means 2 operates to strongly press the pinch rollers 10 on the drive roller 9 to strongly nip the chain C. When the crank lever 47 moves, the rear end portion thereof engages the cam surface 64 of the swing plate 59 to make the plate 59 return to its upright position and to make the microswitch M1 return to the original condition.

Figure 20:
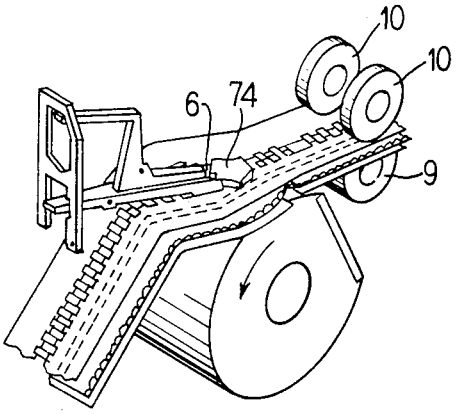
Figure 21:
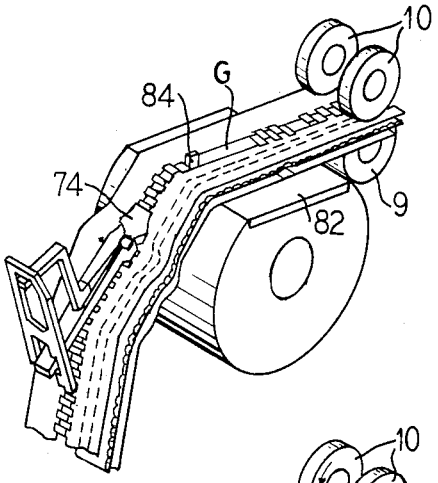

(11) The microswitch M8 is actuated. By this, the piston rod 91 of the air cylinder 90 retracts to rotate the rotor R in the counterclockwise direction as seen in FIG. 20. Accordingly, the slider 74 is retained in the slider holding portion 76 is slid on the separated rows of the elements through the enlarged gap G. When the slider is slid on the elements, the pin 85 of the rotor R engages the extension 39 of the gap sensor and enlarger means 5 to rotate the means 5 and the rotor R in unison. In this manner, the means 5 moves from its normal position as shown in FIG. 2 to its retracted position as shown in FIG. 3. When the device 5 rotates, the V-shaped cam 48 of the crank lever 47 successively separates the further upstream interengaged fastener elements to facilitate movement of the slider on the elements. When the rotor rotates, the claws 43 of the detector 42 ride on the elements to make the detector 42 return to its original position. When the rotor R is stopped by engagement between the pin 86 on the rotor and the bolt 88 on the stop plate 87, the die plate 82 takes a position opposite to the punch 120 and the cutter 121 and the pin 84 on the die plate engages the end of the chain of the elements interengaged by movement of the slider as shown in FIG. 21.

Figure 22:
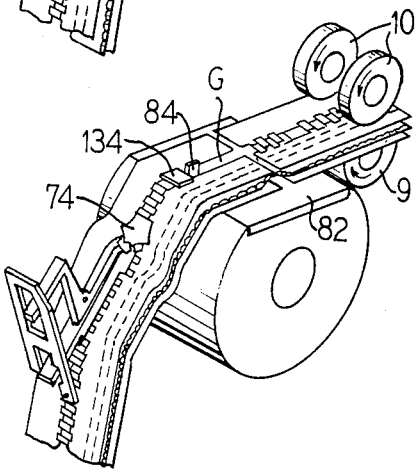
Figure 23:
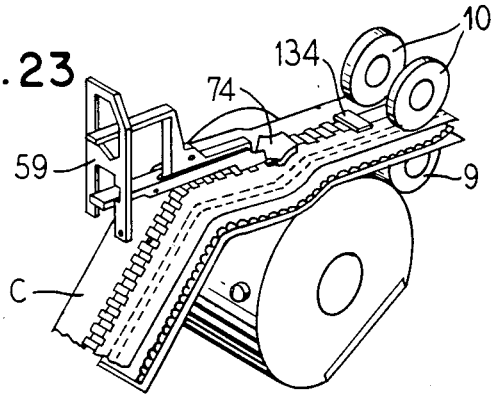

(12) Just before the rotor R stops rotation, the swing arm assembly 27 hits the microswitch M2. This causes the piston rod 50 of the cylinder 49 to retract to make the crank lever 47 return to its original position and also causes the piston rod of the cylinder 20 of the main drive roller means 2 to retract thereby reducing the pressure from the pinch rollers 10 and releasing the gripping effect on the fastener chain. Simultaneously with this operation, the piston rod 119 of the cylinder 117 extends to move down the punch 120 and the cutter 121 so that the bottom stop 134 is fixed to the end of the interengaged element chain and the fastener chain is cut at the gap G to form a fastener as shown in FIG. 22.

(13) When the punch 120 and the cutter 121 descend, the link 113 hits the microswitch M3. This energizes the electro-magnetic clutch 14 of the main drive roll means 2 to rotate the drive roll 9 again to discharge the cut fastener.

(14) The microswitch M7 returns to its original condition. This causes the piston rod 119 of the cylinder 117 to retract to raise the punch 120 and the cutter 121.

(15) The microswitch M3 returns to the original condition.

(16) The microswitch M5 returns to its original condition to make the clamp piston device 80 take the original position thereby releasing the slider.

(17) The microswitch M8 returns to its original condition. This causes the piston rod of the cylinder 90 to extend to rotate the rotor R in the opposite direction until the pin 85 on the rotor engages the stop plate 87 where the rotor resumes the original position. According to this operation, the gap sensor and enlarger means 5 returns to its original position by the effect of the spring 72. When the rotor and the gap sensor and enlarger means return to their original positions, the end of the cut fastener chain is advanced due to the returning movement of the rotor and the gap sensor and enlarger means to the nip between the rotating drive and pinch rolls 9 and 10 so that subsequent feeding of the chain again takes place and the cycle repeats.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for attaching sliders to a slide fastener chain having alternating longitudinal portions of engaged fastener elements and fastener element-free gaps, comprising feed means for drawing said chain in a downstream direction past a sensing means, said sensing means for detecting each said gap passing thereby and halting said feed means to position said gap in an assembly station, spreading means for transversely widening said gap and partially uncoupling upstream fastener element rows, a rotor having a slider holding means for seizing a slider, passing said slider to said widened gap, threading said slider in an upstream direction onto said uncoupled fastener element rows, and releasing said slider at corresponding positions of rotation of said rotor and, means for delivering sliders one at a time to said slider holding means.

2. The apparatus of claim 1, wherein said chain overlies said rotor substantially tangential to the rotor periphery, said slider holding means supporting said slider against the rotor periphery.

3. The apparatus of claim 2, wherein said slider has a pull, said slider holding means comprises a radial recess in and open to one end of said rotor for receiving the pull of said slider and a releasable clamp means for controllably locking the slider pull in said recess and said means for delivering sliders faces said one end of said rotor and directs the pull of each slider into said recess.

4. The apparatus of claim 1, wherein said rotor oscillates back and forth through a predetermined angle.

5. The apparatus of claim 1, wherein said sensing means and spreading means are mounted together in an assembly movable over said chain, said rotor having abutment means for engaging said assembly during rotation through said threading said slider position to move said assembly in an upstream direction over said chain ahead of said slider.

6. In apparatus for assembling sliders on a continuous fastener chain having alternating fastener element and fastener-element-free gap sections longitudinally therealong, a slider transport assembly comprising a rotor rotatable about an axis perpendicular to the direction of longitudinal movement of said chain, said rotor having a releasable clamping means communicating with the interior of a recess extending radially from said rotor periphery, a slider feed means for delivering sliders, each having a pull tab and body portion, one at a time to said recess such that the pull tab of each slider extends into said recess and the body portion abuts against said rotor periphery, and means for rotating said rotor to pass each said slider to said chain, whereupon each said slider is threaded onto fastener elements of said chain.

7. In apparatus for assembling sliders on a continuous fastener chain having longitudinally alternating engaged fastener element containing and fastener-element-free gap portions, an assembly station through which said chain is conducted longitudinally in a first direction comprising a device for detecing each gap portion and spreading said gap portion to permit a slider to be threaded onto chain fastener elements in a second longitudinal direction opposite said first direction, said device having a pair of parallel fingers resiliently biased against one side of said chain to enter each said gap portion, and a movable cam surface disposed between said fingers to descend between said fingers and spread said fingers upon their entry into said gap portion.

8. The assembly of claim 7, further comprising a rotor rotatable about an axis perpendicular to said first longitudinal direction, said rotor having means for holding sliders tangentially against the rotor periphery and being rotatable to pass said sliders to said gap portions and thread them onto said chain fastener elements after said fingers are spread.

9. The assembly of claim 8, wherein said device is pivotable about said rotor axis and said rotor is formed with means for abutting against said device to pivot said device for movement along said chain in said second direction during rotation of said rotor while said sliders are being threaded onto said chain fastener elements.

* * * * *